US006041998A

United States Patent [19]

Goldberg

[11] Patent Number: 6,041,998

[45] Date of Patent: Mar. 28, 2000

[54] FOLDING BOX CONSTRUCTION

[76] Inventor: Leslie H. Goldberg, 77 Mossgrove Trail, Willowdale, Ontario, Canada, M2L 2W2

[21] Appl. No.: 09/358,934

[22] Filed: Jul. 23, 1999

[30] Foreign Application Priority Data

Apr. 20, 1999 [CA] Canada ..... 2269467

[51] Int. Cl.[7] ..... B65D 5/42

[52] U.S. Cl. ..... 229/193; 206/232; 206/459.5; 493/128; 493/162

[58] Field of Search ..... 229/152, 153, 229/193; 206/232, 459.5; 493/121, 128, 162

[56] References Cited

U.S. PATENT DOCUMENTS 2,799,391 7/1957 Eisner ..... 206/232
4,711,348 12/1987 Schluger ..... 206/232
5,289,917 3/1994 Chabria ..... 206/232
5,353,931 10/1994 Antik ..... 206/232
5,513,752 5/1996 Gottlieb ..... 206/232
5,794,631 8/1998 Sylvester ..... 206/232
5,971,261 10/1999 Grunfeld et al. ..... 206/459.5

*Primary Examiner*—Gary E. Elkins
*Attorney, Agent, or Firm*—Shoemaker and Mattare, Ltd.

[57] ABSTRACT

A one-piece blank construction for a flip-lid box includes a rectangular bottom panel, rectangular top panel, panels bridging between the bottom and top, and two flip-lid panels foldably connected to one of the components of the respective side walls. The overall "footprint" of the blank is small because the blank is approximately rectangular, thus effecting the maximum saving of material. The one-piece construction is easy to set up, cuts the wastage of material, and increases strength so as to allow a smaller material thickness to be utilized.

11 Claims, 2 Drawing Sheets

FOLDING BOX CONSTRUCTION

This invention relates to the construction of cardboard boxes and has to do particularly with the design of a blank for a such a box, which presents certain advantages.

BACKGROUND OF THIS INVENTION

Many items for sale on the market are packaged in a box known as a flip-lid box, this being a box with a rectangular top panel and two flip-lids constituted by rectangular flaps approximately the same size as the top panel, hingedly connected to opposed side edges of the top panel. These flip-lids are typically used to present more information about the contents of the box, i.e. more than could be applied using the box alone, without the flip-lids.

In the industry concerned, it is typical to utilize 60" and 40" offset presses and die-cutting equipment. Designs of previous flip-lid boxes have required the more expensive 60" offset press and die-cutter, due to the design of the blank. Also, it has been necessary in the past to construct the flip-lid box from two components, which further increases the cost.

GENERAL DESCRIPTION OF THIS INVENTION

In view of the shortcomings of the current design for a flip-lid box construction, it is an aim of one aspect of this invention to provide a one piece blank design, which is such as to provide all parts of the final box, and moreover to permit the utilization of the less expensive 40" offset press and die-cutter.

Furthermore, it is an aim of another aspect of this invention to provide only a single entry/closure feature, such that loading, closing and re-opening the package always occurs at the single closure. This results in a lower labour factor.

The present design involves the elimination of the glue lap, and this reduces the material requirement by about 9%.

It is an aim of a further aspect of this invention to provide an increase in the integral strength of side panel assemblies, by virtue of being attached to the flip-lids. This increase in integral strength permits a reduction in the boxboard thickness required to manufacture the cartons. Typically, the thickness can be reduced from 0.24" to 0.020". This is a decrease of approximately 17%. It has been determined that a 20% reduction in boxboard thickness, coupled with the 9% material reduction compared to previous carton styles, achieves an outstanding overall savings of about 29%.

More particularly, this invention provides a blank for a folding box, comprising:

a rectangular bottom panel having a pair of opposed side edges and a pair of opposed end edges, a first rectangular end panel foldably connected to said bottom panel at one of said end edges thereof, thus defining a first fold-line, a rectangular top panel having a pair of opposed side edges and a pair of opposed end edges, the top panel being foldably connected to said end panel at an end edge of the top panel, thus defining a second fold-line remote from and parallel to said first fold-line, a second rectangular end panel foldably connected to the other end edge of the top panel, thus defining a third fold-line remote from and parallel to said second fold-line, a tuck flap foldably connected to said second end panel at a fourth fold-line remote from and parallel to said third fold-line;

each of the opposed side edges of the top panel having a rectangular adhesion side wall foldably connected thereto, thus defining fifth and sixth fold lines, each side edge of the bottom panel having a rectangular adherent side wall foldably connected thereto, thus defining seventh and eighth fold-lines perpendicular to the first fold-line, first and second rectangular flip lid panels foldably connected to the two adherent side walls, respectively, at ninth and tenth fold-lines parallel with said seventh and eighth fold-lines, and connecting means for fastening each adhesion side wall to a respective adherent side wall such that each adherent side wall lies outwardly of its respective adhesion side wall.

Furthermore, this invention provides a method for setting up a box, utilizing a blank which comprises:

a rectangular bottom panel having a pair of opposed side edges and a pair of opposed end edges, a first rectangular end panel foldably connected to said bottom panel at one of said end edges thereof, thus defining a first fold-line, a rectangular top panel having a pair of opposed side edges and a pair of opposed end edges, the top panel being foldably connected to said end panel at an end edge of the top panel, thus defining a second fold-line remote from and parallel to said first fold-line, a second rectangular end panel foldably connected to the other end edge of the top panel, thus defining a third fold-line remote from and parallel to said second fold-line, a tuck flap foldably connected to said second end panel at a fourth fold-line remote from and parallel to said third fold-line;

each of the opposed side edges of the top panel having a rectangular adhesion side wall foldably connected thereto, thus defining fifth and sixth fold lines, each side edge of the bottom panel having a rectangular adherent side wall foldably connected thereto, thus defining seventh and eighth fold-lines perpendicular to the first fold-line, first and second rectangular flip lid panels foldably connected to the two adherent side walls, respectively, at ninth and tenth fold-lines parallel with said seventh and eighth fold-lines, and connecting means for fastening each adhesion side wall to a respective adherent side wall such that each adherent side wall lies outwardly of its respective adhesion side wall, the method comprising the steps:

applying the connecting means to the blank such that it will connect together each adhesion side wall and its respective adherent side wall, and folding the top panel over so that it overlies the bottom panel but is spaced above the bottom panel, while correcting the adherent and adhesion side walls together in parallel, overlapped relation.

GENERAL DESCRIPTION OF THE DRAWINGS

One embodiment of this invention is illustrated in the accompanying drawings, in which like numerals denote like parts throughout the several views, and in which:

FIG. 1 is a plan view of a cut and creased boxboard blank, showing the overall configuration; and FIGS. 2, 3, 4 and 5 are perspective views of the boxboard blank of FIG. 1, showing the various steps in setting up the box.

DETAILED DESCRIPTION OF THE DRAWINGS

Figure 1:
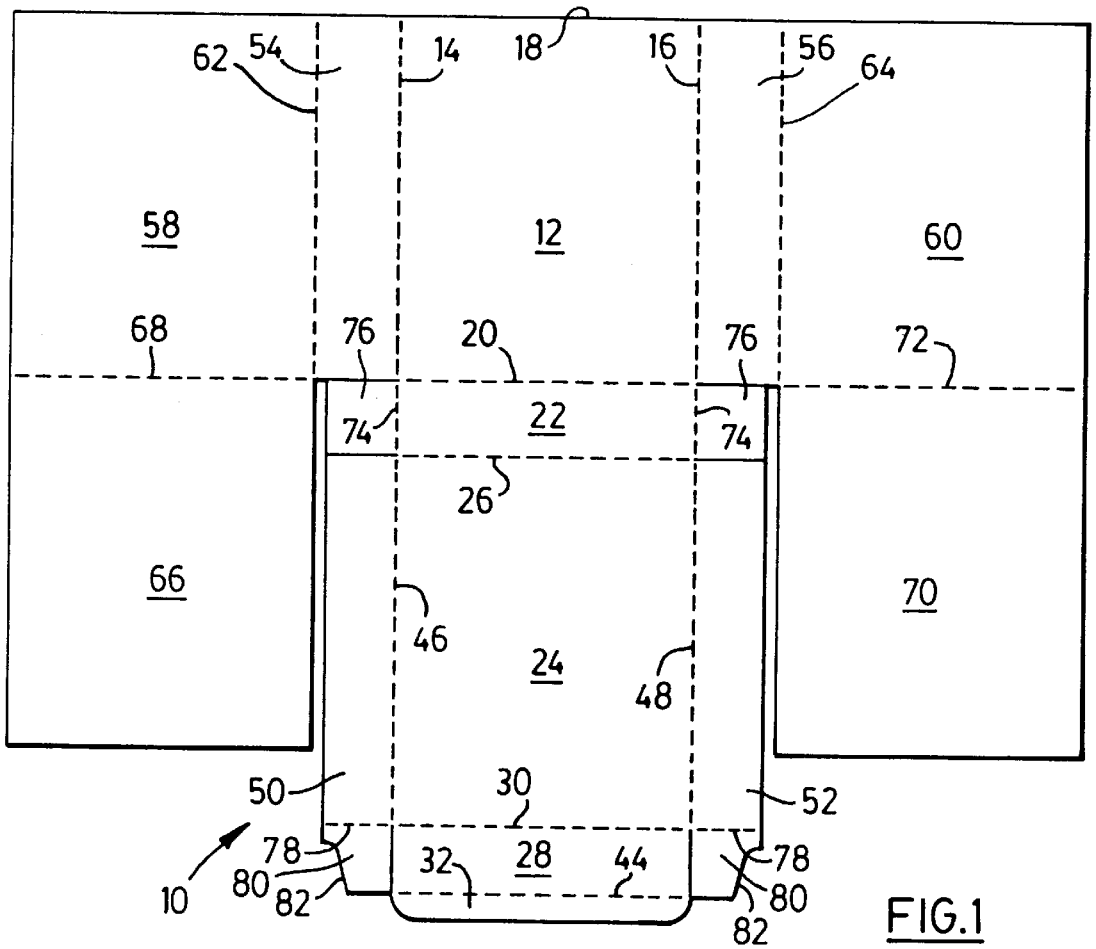

Attention is first directed to FIG. 1, which shows a blank 10 for a folding box. Specifically, the blank 10 includes a rectangular bottom panel 12 having a pair of opposed side edges 14, 16, and a pair of opposed end edges 18 and 20.

A first rectangular end panel 22 is foldably connected to the bottom panel 12 at the end edge 20, whereby the end edge becomes a first fold-line 20.

A rectangular top panel 24 is foldably connected to the end panel 22 at a second fold-line 26 which is remote from and parallel to the first fold line 20. A second rectangular end panel 28 is foldably connected to the top panel 24 at a third fold line 30 remote from and parallel to the second fold line 26.

A tuck flap 32 is foldably connected to the second end panel 28 at a fourth fold line 44 remote from and parallel to the third fold line 30.

The top panel 24 has a pair of opposed side edges 46, 48, which are parallel with and aligned with the side edges 14, 16, respectively, of the bottom panel, each top panel side edge 46, 48 having a rectangular adhesion side wall 50, 52, respectively, foldably connected thereto, thus defining fifth and sixth fold lines coinciding with the side edges 46, 48 respectively.

Each side edge 14, 16 of the bottom panel 12 has a rectangular adherent side wall 54, 56, respectively, foldably connected thereto, thus defining seventh and eighth fold lines perpendicular to the first fold line at the end edge 20 of the bottom panel 12. Thus the side edges 14 and 16 of the bottom panel 12 are coincident with the seventh and eighth fold lines.

Rectangular flip-lid panels 58, 60 are foldably connected to the two adherent side walls 54, 56, respectively, at ninth and tenth fold lines 62, 64, respectively, which are parallel with the seventh and eighth fold lines (14, 16).

As illustrated, the blank 10 further comprises a third flip-lid panel 66 congruent with the first flip-lid panel 58 and foldably connected thereto at an eleventh fold line 68 which constitutes an edge of the first flip-lid panel 58. Likewise, a fourth flip-lid panel 70 is congruent with the second flip-lid panel 60, and is foldably connected thereto at a twelfth fold line 72 which constitutes an edge of the second flip-lid panel 60.

As shown in FIG. 1, the first rectangular end panel 22 has opposed end edges 74 which are perpendicular to the first and second fold lines 20, 26. Each of the end edges 74 has an end edges stabilizing flap 76 foldably secured thereto.

Furthermore, each adhesion side wall 50, 52 has an end edge 78 which is parallel to and collinear with the third fold line 30. Furthermore, a side wall stabilizing flap 80 is foldably secured to with respective adhesion side wall 50, 52.

As based seen in FIG. 1, each of the stabilizing flaps 80 has a sloping partial wall 82.

Figure 3:
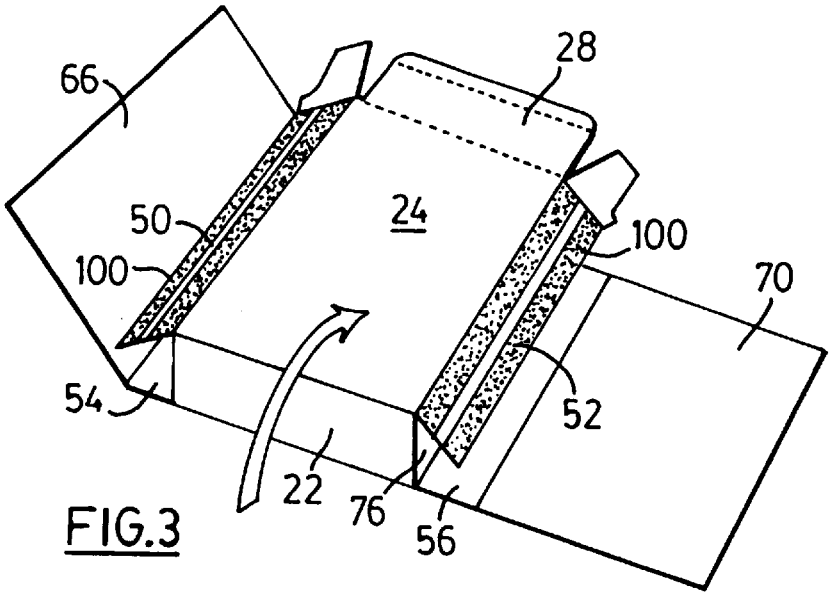

As best seen in FIG. 3, the blank includes adhesive means 100 for adhering each adhesion side wall 50, 52 to the corresponding adhesion side wall 54, 56, respectively. In FIG. 3, the adhesive means takes the form of two double-sided adhesive tapes located on each adhesion side wall 50, 52. In the blank shown in FIG. 1, the tapes are located on the underside of the adhesion side walls 50, 52, which will become apparent below, where the process of setting up the box is described.

Figure 2:
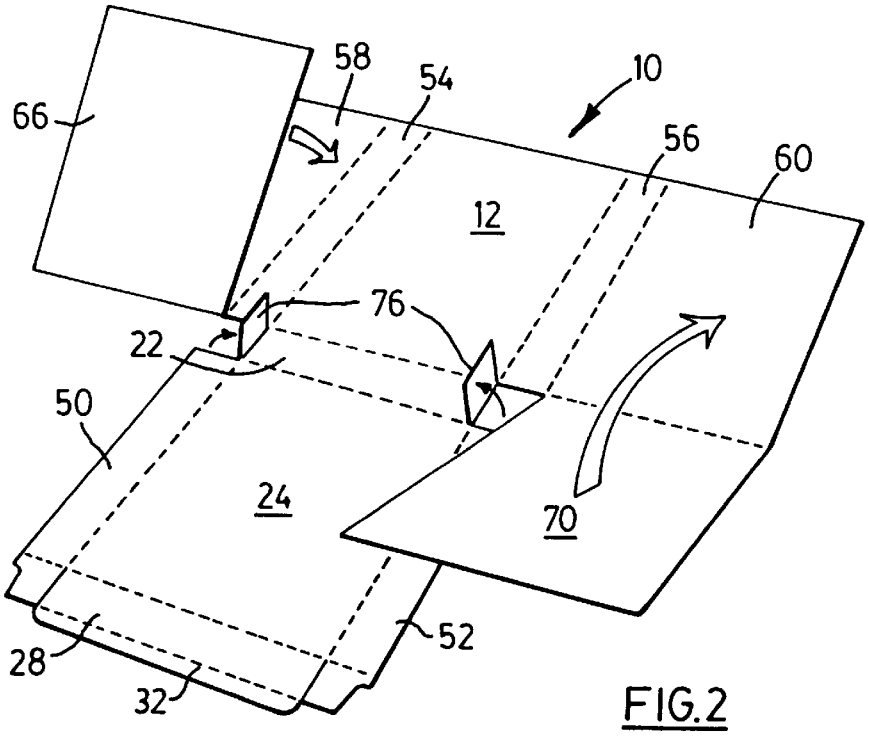

Attention is directed to FIG. 2, which shows the blank 10 at the start of the set-up procedure. In FIG. 1, the top panel 24, the adhesion side walls 50, 52, the bottom panel 12, the adherent side wall 54, 56 and the rectangular flip-lid panels 58 and 60 are all in the flattened condition. However, the stabilizing flaps 76 have been raised to an upright position, and the third and fourth flip-lid panels 66 and 70 are in the midst of being folded to lie in surface contact and overlapping relationship with the respective flip-lid panels 58 and 60.

As seen in FIG. 3, the flip-lid panels 66 and 70 are now in overlapping, surface-contacting relation with the flip-lid panels 58 and 60, respectively. In FIG. 3, the top panel 24 has been rotated through almost 180°, so that the end panel 22 is more or less upright with respect to the bottom panels 12, and the adhesion side walls 50, 52 are in the process of being folded downwardly. It is pointed out again that FIG. 3 shows the double sided tape 100, but the tape is not visible in FIG. 1, because FIG. 1 shows the opposed face of the top panel 24.

Figure 4:
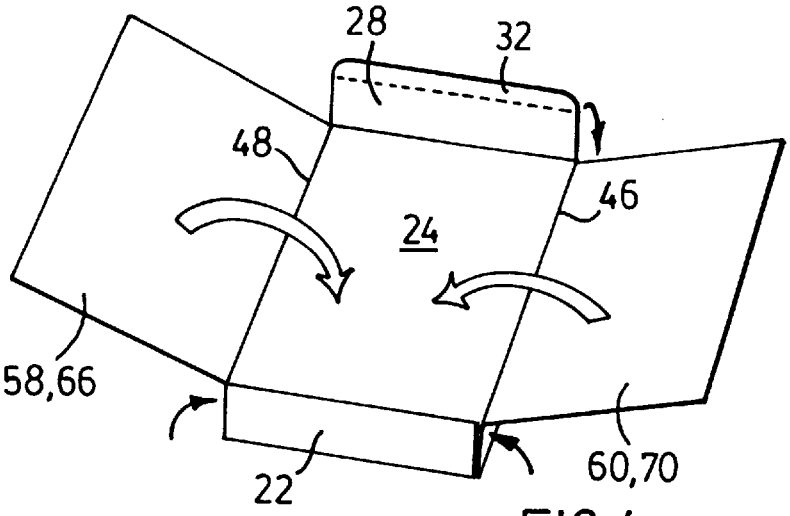

Assuming that the double sided tape 100 (or whatever adhesive is being utilized) is ready to come into contact with the adherent side walls 54 and 56, the adhesion side walls 50 and 52 are pushed into an upright position, capturing the stabilizing flaps 76. The adhesion side walls 50 and 52 will then be lined up with the side edges 14, 16 of the bottom panel 12 (not visible in FIG. 3). When this occurs, the adherent side walls 54 and 56 can be folded upwardly and inwardly so that they fully overlap and adhere to the respective adhesion side walls 50, 52. This will raise the fold lines 62, 64 to be coincident with the side edges of the top panel 24, these being identified by the numerals 46 and 48 in FIG. 4. In FIG. 4, the second end panel 28 and the tuck flap 32 are shown bent upwardly at an angle, thereby to open the far end of the box (as pictured in FIG. 4), in order that the product may be inserted or removed.

Figure 5:
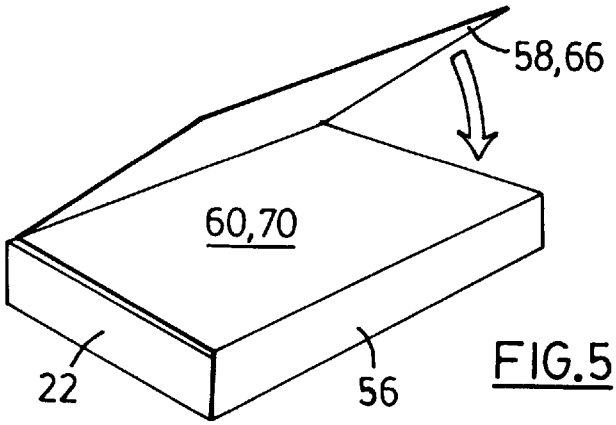

To complete the box for shipping or storage, the flip-lids 58/66 and 60/70 are folded across the top of the top panel 24. This is pictured in FIG. 5, with the outermost flip-lid 58/66 having only a further 20° or so to rotate in order to bring it into flat contact with the flip-lid 60/70.

It is pointed out that the flip lids in the illustrated embodiment, each being constituted of two layers of boxboard, may be stiffer or heavier than is required in a given application. In such a case, the flip-lids 66 and 70 may simply be omitted.

It should also be indicated that double-side tape 100 is only one modality for adhering together the adhesion side walls and the adherent side walls. Obviously, it would be possible to use liquid glue, heat-activated adhesives, or other means of securing two flat panels in surface contact with each other.

It will be seen that this invention offers a single piece construction requiring a minimal amount of gluing, allowing the box to function as a multipanel advertising medium, reusable software storage box and retail packaging (as one of many examples). It is a significant advantage that only a single piece of boxboard is required. Previous constructions utilizing two pieces were complex and required 60" offset press and die-cutting equipment to yield a similar product. The closure involving the end panel 28 and tuck flap 32 is such that only one entry/closure feature is required in order to load, close and re-open the package. This cuts labour costs during packaging. The flip-lids are created within the single piece construction, eliminating the glue lap. This has reduced the material requirement by about 9%. The adhering side panel assemblies attached to the flip-lids substantially increase the strength of the box. As mentioned earlier, boxboard thickness can be reduced with this design, typically from 0.24" to 0.020".

A previously mentioned, the package can be produced on single pass 40" printing equipment. The one-piece construction has reduced waste by 17%, has reduced the amount of square inches required to make the box by 9%, and has permitted the overall thickness of the carton material to be reduced. Because of the unique construction, the integrity of the carton has been increased.

While one embodiment of this invention has been illustrated in the accompanying drawings and described hereinabove, it will be evident to those killed in the art that changes and modifications may be made therein without departing from the essence of this invention, as set forth in the appended claims.

The embodiments of the invention in which an exclusive property or privilege is claimed are defined as follows:

1. A blank for a folding box, comprising:

a rectangular bottom panel having a pair of opposed side edges and a pair of opposed end edges, a first rectangular end panel foldably connected to said bottom panel at one of said end edges thereof, thus defining a first fold-line, a rectangular top panel having a pair of opposed side edges and a pair of opposed end edges, the top panel being foldably connected to said end panel at an end edge of the top panel, thus defining a second fold-line remote from and parallel to said first fold-line, a second rectangular end panel foldably connected to the other end edge of the top panel, thus defining a third fold-line remote from and parallel to said second fold-line, a tuck flap foldably connected to said second end panel at a fourth fold-line remote from and parallel to said third fold-line; p1 each of the opposed side edges of the top panel having a rectangular adhesion side wall foldably connected thereto, thus defining fifth and sixth fold lines, each side edge of the bottom panel having a rectangular adherent side wall foldably connected thereto, thus defining seventh and eighth fold-lines perpendicular to the first fold-line, first and second rectangular flip lid panels foldably connected to the two adherent side walls, respectively, at ninth and tenth fold-lines parallel with said seventh and eighth fold-lines, and connecting means for fastening each adhesion side wall to a respective adherent side wall such that each adherent side wall lies outwardly of its respective adhesion side wall.

2. The invention claimed in claim 1, in which the first and second flip lid panels are rectangular, the blank further comprising a third flip lid panel congruent with the first flip lid panel and foldably connected thereto at an eleventh fold line constituting an edge of the first flip lid panel, and a fourth flip lid panel congruent with the second flip lid panel and foldably connected thereto at a twelfth fold line constituting an edge of the second flip lid panel.

3. The invention claimed in claim 2, further comprising adhesive means for adhering the first and third flip lid panels together in overlapped relation, and for adhering the second and fourth flip lid panels together in overlapped relation.

4. The invention claimed in claim 2, in which the eleventh and twelfth fold lines are collinear with each other and with said first fold line.

5. The invention claimed in claim 2, in which said first rectangular end panel has opposed end edges perpendicular to said first and second fold lines, each said end edge of the first end panel having an end edge stabilizing flap foldably secured thereto, and each said adhesion side wall having an end edge parallel to and collinear with said third fold line, with a side wall stabilizing flap foldably secured thereto.

6. The invention claimed in claim 1, in which said connecting means comprises at least one strip of double-adhesive tape applied to each adhesion side wall, such that the at least one strip of tape lies between its respective adhesive side wall and the corresponding adhesion side wall.

7. A method for setting up a box, utilizing a blank which comprises:

a rectangular bottom panel having a pair of opposed side edges and a pair of opposed end edges, a first rectangular end panel foldably connected to said bottom panel at one of said end edges thereof, thus defining a first fold-line, a rectangular top panel having a pair of opposed side edges and a pair of opposed end edges, the top panel being foldably connected to said end panel at an end edge of the top panel, thus defining a second fold-line remote from and parallel to said first fold-line, a second rectangular end panel foldably connected to the other end edge of the top panel, thus defining a third fold-line remote from and parallel to said second fold-line, a tuck flap foldably connected to said second end panel at a fourth fold-line remote from and parallel to said third fold-line;

each of the opposed side edges of the top panel having a rectangular adhesion side wall foldably connected thereto, thus defining fifth and sixth fold lines, each side edge of the bottom panel having a rectangular adherent side wall foldably connected thereto, thus defining seventh and eighth fold-lines perpendicular to the first fold-line, first and second rectangular flip lid panels foldably connected to the two adherent side walls, respectively, at ninth and tenth fold-lines parallel with said seventh and eighth fold-lines, and connecting means for fastening each adhesion side wall to a respective adherent side wall such that each adherent side wall lies outwardly of its respective adhesion side wall, the method comprising the steps:

applying the connecting means to the blank such that it will connect together each adhesion side wall and its respective adherent side wall, and folding the top panel over so that it overlies the bottom panel but is spaced above the bottom panel, while connecting the adherent and adhesion side walls together in parallel, overlapped relation.

8. The method claimed in claim 7, in which the first and second flip lid panels are rectangular, the blank further comprising a third flip lid panel congruent with the first flip lid panel and foldably connected thereto at an eleventh fold line constituting an edge of the first flip lid panel, and a fourth flip lid panel congruent with the second flip lid panel and foldably connected thereto at a twelfth fold line constituting an edge of the second flip lid panel, the method further including adhering together the first and third flip lid, and the second and fourth flip lid.

9. The invention claimed in claim 8, in which the eleventh and twelfth fold lines are collinear with each other and with said first fold line.

10. The invention claimed in claim 8, in which said first rectangular end panel has opposed end edges perpendicular to said first and second fold lines, each said end edge of the first end panel having an end edge stabilizing flap foldably secured thereto, and each said adhesion side wall having an end edge parallel to and collinear with said third fold line, with a side wall stabilizing flap foldably secured thereto.

11. The invention claimed in claim 7, in which said connecting means comprises at least one strip of double-adhesive tape applied to each adhesion side wall, such that the at least one strip of tape lies between its respective adhesive side wall and the corresponding adhesion side wall.

* * * * *